US007108565B2

(12) United States Patent
Boischio

(10) Patent No.: US 7,108,565 B2
(45) Date of Patent: Sep. 19, 2006

(54) CONNECTION ASSEMBLY FOR ELECTRICAL CABLES, OF THE TYPE FOR CONNECTION TO CONNECTORS WITH CYLINDRICAL-PIN TERMINALS

(75) Inventor: Ido Boischio, Padua (IT)

(73) Assignee: Inarca S.p.A., Vigodarzere (IT)

( * ) Notice: Subject to any disclaimer, the term of this patent is extended or adjusted under 35 U.S.C. 154(b) by 0 days.

(21) Appl. No.: 11/261,649

(22) Filed: Oct. 31, 2005

(65) Prior Publication Data

US 2006/0116028 A1 Jun. 1, 2006

(30) Foreign Application Priority Data

Nov. 26, 2004 (IT) ..... PD20040085 U

(51) Int. Cl.
*H01R 13/04* (2006.01)

(52) U.S. Cl. ..... 439/694; 439/749

(58) Field of Classification Search ..... 439/694, 439/902, 625, 626, 660, 692, 106, 374, 597, 439/617, 638, 647, 651, 655, 746, 752, 74
See application file for complete search history.

(56) References Cited

U.S. PATENT DOCUMENTS 3,336,567 A * 8/1967 Coldren ..... 439/685
3,753,193 A * 8/1973 Teagno et al. ..... 439/854
3,764,960 A * 10/1973 Heimbrock ..... 439/749
3,842,396 A * 10/1974 Olsson ..... 439/685
4,109,992 A * 8/1978 Hughes et al. ..... 439/620
4,917,634 A 4/1990 Geib et al.
5,295,871 A 3/1994 Lapraik et al.
6,902,438 B1 * 6/2005 Tsuyama ..... 439/694
2001/0039145 A1 * 11/2001 Schaefer et al. ..... 439/625

FOREIGN PATENT DOCUMENTS

DE 198 14 401 A1 10/1999
GB 1 001 392 A 8/1965

* cited by examiner

*Primary Examiner*—Truc T. Nguyen
*Assistant Examiner*—Edwin A. Leon
(74) *Attorney, Agent, or Firm*—Modiano & Associati; Albert Josif; Daniel J. O'Byrne

(57) ABSTRACT

A connection assembly for electrical cables, for connection to connectors with cylindrical-pin terminals, having a connector with guides inside for stable locking and accommodation of electrical terminals. Each terminal is constituted by a base with portions folded so as to form a substantially three-dimensional volume. Two opposite elastically flexible wings protrude from the folded portions toward the crimping region of the terminal converging toward the longitudinal centerline of the terminal. Free ends of the wings inserted in a corresponding guide are arranged in recesses which are undercut with respect to the direction of insertion and are formed on opposite sides of an internal rib of the guide; the connector is provided with an abutment for the non-crimped end of the corresponding inserted electrical terminal locked between the recesses and the abutment.

5 Claims, 3 Drawing Sheets

CONNECTION ASSEMBLY FOR ELECTRICAL CABLES, OF THE TYPE FOR CONNECTION TO CONNECTORS WITH CYLINDRICAL-PIN TERMINALS

BACKGROUND OF THE INVENTION

The present invention relates to a connection assembly for electrical cables, of the type for connection to connectors with cylindrical-pin terminals.

In particular, the connection assembly can be used preferably in the connection between the power supply cables of the electric motor of a compressor for electrical appliances and the cables for connection to the external mains.

An assembly for connecting electrical cables to connectors provided with cylindrical-pin terminals is known which is used typically in the connection between the power supply cables of the electric motor of a compressor for electrical appliances and the cables for connection to the external mains.

Said connection assembly comprises a connector made of plastic material, which is known in the field of reference also as "cluster" and forms internally mutually parallel guides for accommodating and stably locking respective electrical terminals.

These guides have, on a common wall of the connector, respective circular through holes, which can be used for the insertion of the cylindrical pins of the additional connector with which the connection assembly must associate (typically a connector with three cylindrical pins arranged like the corners of an equilateral triangle).

Each electrical terminal is constituted by a base, on which there is a region for crimping to electrical cables and a region for electrical contact.

At said electrical contact region there is a through opening in which it is possible to insert, in electrical contact with said terminal, a respective cylindrical pin of the additional connector with which the connection assembly must associate.

On mutually opposite sides of the base there are portions which are folded (so as to obtain a three-dimensional volume) and form means for locking the electrical terminal in the respective guide.

Said folded portions in fact protrude from the base outward in diverging directions and are flexible (flexing occurs transversely to the base).

The guides are narrower than the distance between the ends of the folded portions; therefore, during the insertion of each terminal in the corresponding guide, the folded portions flex toward the center of said terminal.

Wider regions are provided on the side walls of each guide and form abutments which are undercut with respect to the direction of insertion of the terminal in said guide.

Once the folded portions have reached said wider regions during insertion, they resume their initial (not flexed) shape, thus occupying the wider regions.

An abutment is provided on the bottom of each guide for the non-crimped end of the corresponding inserted electrical terminal.

The electrical terminal is thus locked between the recesses and the abutment.

With the terminal inserted in the corresponding guide, the circular through hole of the connector is superimposed on the through opening of the terminal for the insertion of the electrical connection pin.

This known type of connection assembly, however, has drawbacks linked both to the step for inserting the electrical terminal in the connector and to the step for crimping the electrical terminal to the corresponding cable.

The cantilevered parts of the folded portions designed to be deformed elastically by flexing are in fact limited in length (in the direction of flexing) due to issues of terminal bulk.

For this reason, the load for the insertion of the terminal in the connector is high (the folded portions flex scarcely because they are "short").

This can lead to cases in which the terminal is not inserted perfectly in the connector, thus leading to an inaccurate superimposition of the circular through hole of the connector on the through opening of the terminal, making it consequently difficult or impossible to insert the cylindrical pins therein.

Moreover, for this same reason, the load for extraction of the terminal from the guide can be practically non-existent.

Another drawback occurs during the step for crimping the electrical cables to the electrical terminals.

Said crimping generally occurs by means of automated equipment, which comprises a small press under which the terminal and the cable are arranged.

The terminal is generally stored in a spool (in practice, the terminals are formed by a single tape which is pressed progressively).

The terminal is then brought to the press by unwinding the reel; the descent of the press cuts the terminal and deforms it so as to crimp the wire.

With terminals that can be used in this connection assembly, there are often problems during the feeding of the press; the unwinding of the reel is in fact problematic, owing to the portions that are folded laterally to the base of the terminal.

The folded portions of the contiguous terminals, by protruding toward the outside of each base, during the unwinding of the reel tend to interlock and become "entangled" with the contiguous terminals, requiring machine halting and operator intervention.

SUMMARY OF THE INVENTION

The aim of the present invention is to provide a connection assembly for electrical cables, of the type for connection to connectors with cylindrical-pin terminals, which allows to solve the drawbacks observed in known types.

Within this aim, an object of the present invention is to provide a connection assembly for electrical cables, of the type for connection to connectors with cylindrical-pin terminals, which allows to reduce the load required for the insertion of the electrical terminals in the connector of the connection assembly, at the same time increasing the load required for their extraction.

Another object of the present invention is to provide a connection assembly for electrical cables, of the type for connection to connectors with cylindrical-pin terminals, which allows to ensure correct positioning and locking of the electrical terminals in the corresponding guides of the connector of the connection assembly.

Another object of the present invention is to provide a connection assembly for electrical cables, of the type for connection to connectors with cylindrical-pin terminals, which allows to use electrical terminals which do not have "interlocking" problems during crimping to the respective cables.

Another object of the present invention is to provide a connection assembly for electrical cables, of the type for connection to connectors with cylindrical-pin terminals, which can be manufactured with known systems and technologies.

This aim and these and other objects, which will become better apparent hereinafter, are achieved by a connection assembly for electrical cables, of the type for connection to connectors with cylindrical-pin terminals, which comprises a connector which forms internally guides for the stable locking and accommodation of respective electrical terminals, said guides having, on a common wall of said connector, respective circular through holes, each one of said electrical terminals being provided with a base on which there is a region for crimping to electrical cables and a region for electrical contact, a through opening being provided at said region for electrical contact, a respective cylindrical pin for electrical connection being insertable in said through opening in electrical contact with said terminal, portions being provided on opposite sides of said base which are folded so as to form a three-dimensional volume, said connection assembly being characterized in that it comprises two mutually opposite wings, which can flex elastically and protrude from said folded portions toward said crimping region, converging towards the longitudinal centerline of said terminal, the free ends of the wings of each one of said terminals inserted in a corresponding guide being arranged in recesses which are undercut with respect to the direction of insertion of said terminal in the connector and are formed on the mutually opposite sides of a rib which is internal to said corresponding guide, said connector being provided, at the bottom of each one of said guides, with an abutment for the non-crimped end of the corresponding inserted electrical terminal, when said electrical terminal is substantially locked between said recesses and said abutment, said circular through hole being substantially superimposed on said through opening for the insertion of the electrical connection pin.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 2:
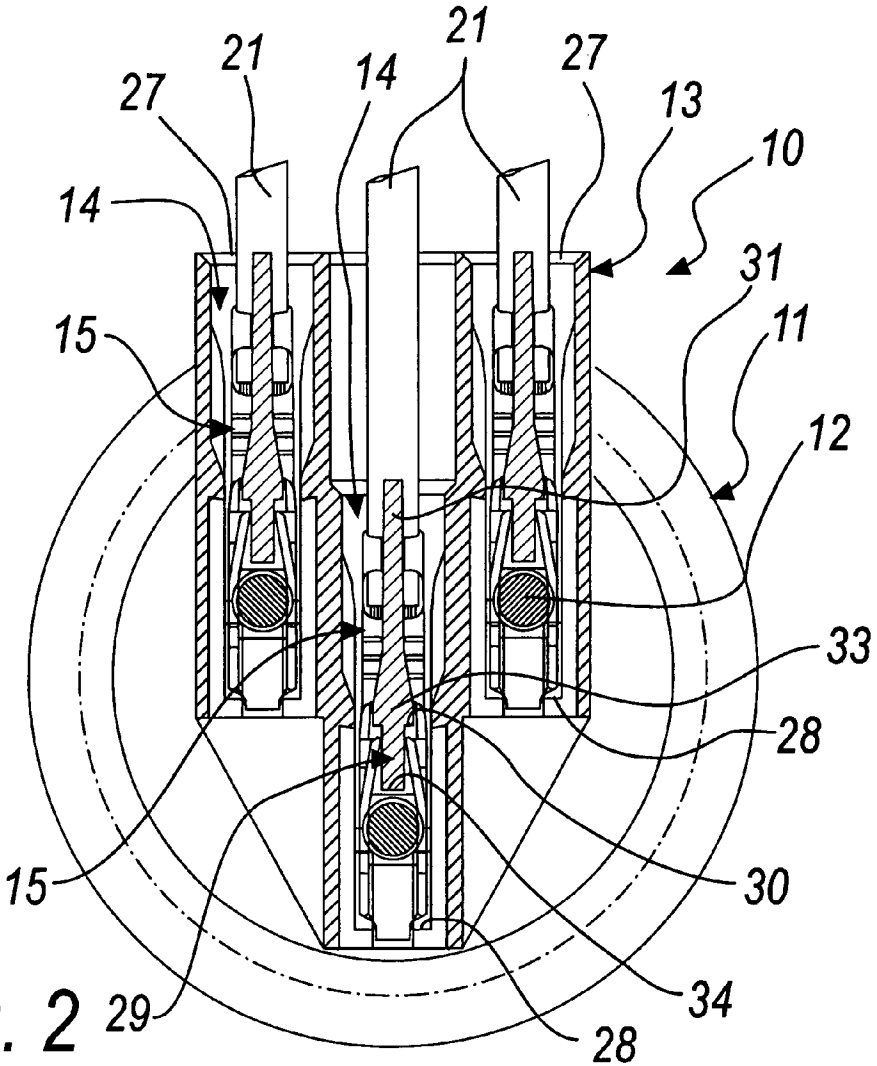
FIG. 2 is a sectional plan view of the connection assembly of FIG. 1, taken along the line II—II of FIG. 1, associated with the same connector of the type with cylindrical-pin terminals.

With reference to the figures, a connection assembly for electrical cables according to the invention is generally designated by the reference numeral 10.

The connection assembly 10 is of the type for connection to connectors with cylindrical-pin terminals; a connector with cylindrical-pin terminals is generally designated by the reference numeral 11 and the corresponding cylindrical pins, arranged at the comers of an equilateral triangle, are designated by the reference numeral 12.

The connection assembly 10 comprises a connector 13, which forms internally three substantially rectilinear guides 14, which are mutually parallel.

Each guide 14 is designed for the stable locking and accommodation of respective electrical terminals 15.

The connector 13 is constituted in practice by three sleeves 16 (which form internally the guides 14), which are provided side-by-side on the same plane; in particular, the central sleeve is not aligned laterally with the other two.

The guides 14 have, on the common wall 17 formed in practice by the plane of arrangement of the three sleeves 16, respective circular through holes 18, which can be used for the insertion of the cylindrical pins 12.

Each electrical terminal 15 is constituted by a base 19, on which there is a region 20 for crimping to an electrical cable 21 and a region 22 for electrical contact with a corresponding cylindrical pin 12.

At the region of electrical contact 22 there is a through opening 23 in which it is possible to insert, in electrical contact with the electrical terminal 22, a corresponding cylindrical pin 12.

Figure 3:
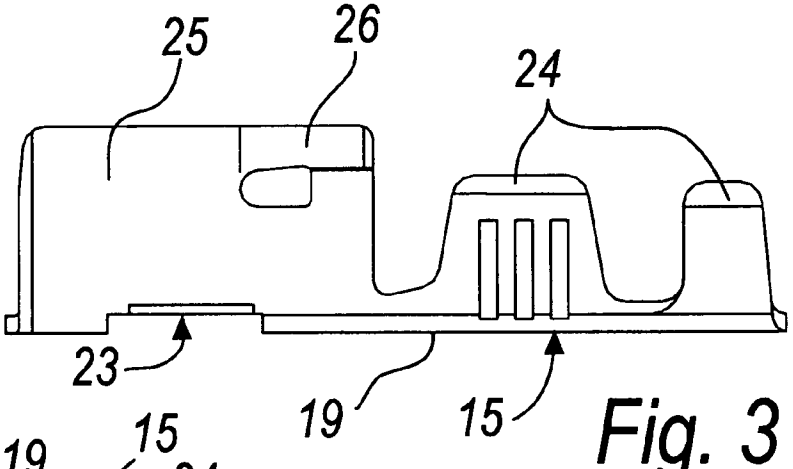
FIG. 3 is a side view of an electrical terminal of the connection assembly of FIGS. 1 and 2.
Figure 5:
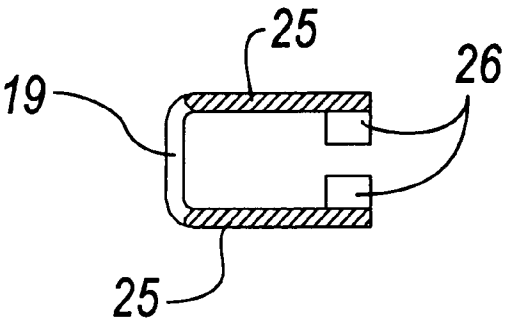
FIG. 5 is a sectional front view of the electrical terminal of FIG. 3, taken along the line V—V of FIG. 4.
Figure 4:
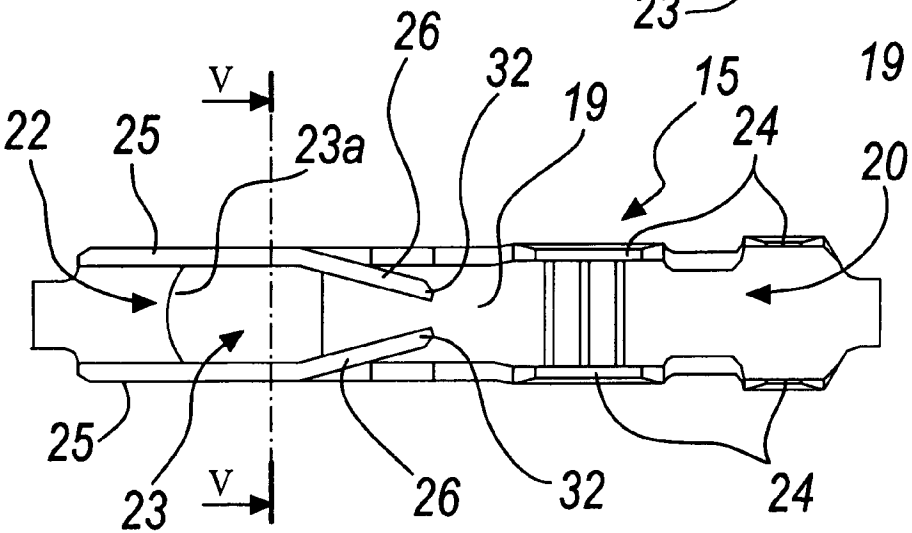
FIG. 4 is a plan view of the electrical terminal of FIG. 3.
Figure 6:
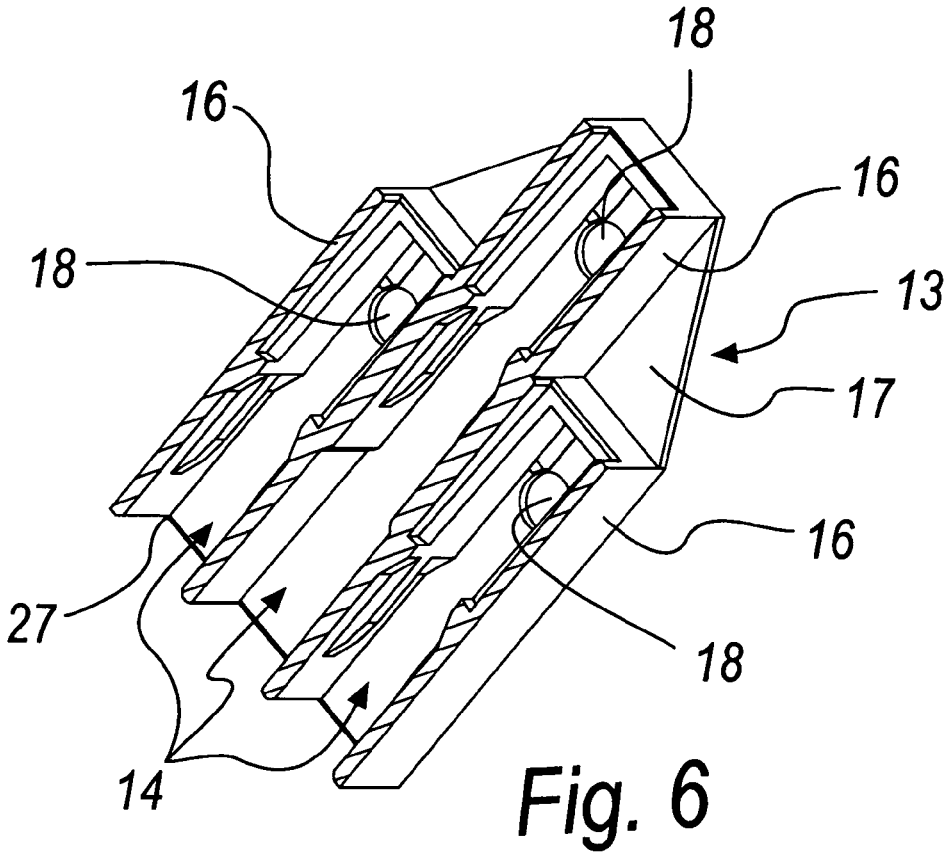
FIG. 6 is a sectional axonometric view of the connector of the connection assembly of FIGS. 1 and 2, taken along a plane which is perpendicular to the cylindrical pins of the connector to which the connection assembly is to be applied.
Figure 7:
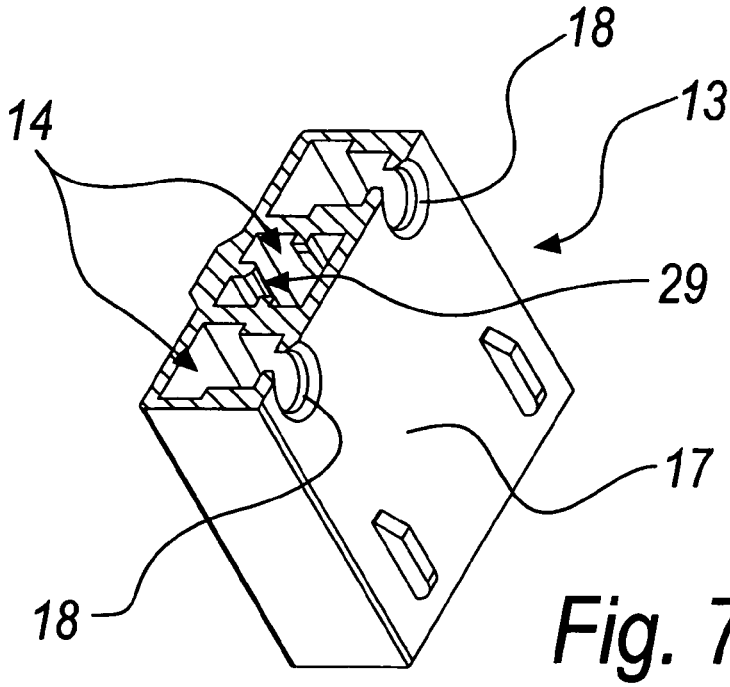
FIG. 7 is a sectional axonometric view of the connector of the connection assembly of FIGS. 1 and 2, taken along a plane which lies transversely to the guides in which the electrical terminals are inserted.

FIGS. 3, 4 and 5 illustrate an electrical terminal 22 before the crimping of the cable 21.

The crimping region 20 has, on mutually opposite sides of the base 19, two pairs of tabs 24, which are mutually spaced and folded upward so as to give a substantially three-dimensional shape to the electrical terminal 15.

Figure 1:
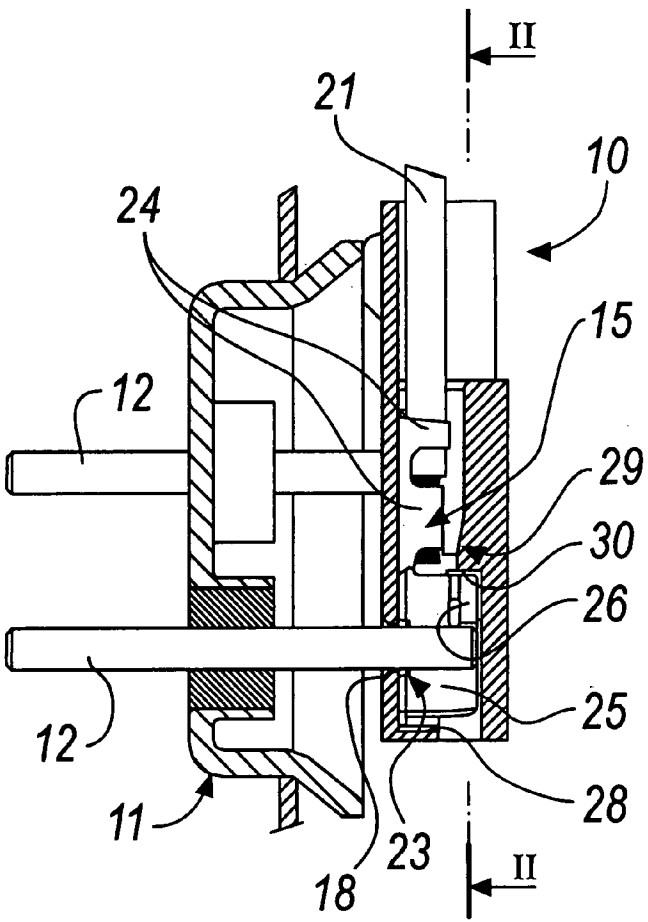
FIG. 1 is a sectional side view, taken along a plane of symmetry, of a connection assembly according to the invention, associated with an additional connector of the type with cylindrical-pin terminals.

The tabs 24, during the crimping of the cable 21, are folded toward the base 19 so as to block the stripped part of the cable (see FIGS. 1 and 2).

Folded portions 25 protrude in the region of electrical contact 22, on mutually opposite sides of the base 19, at right angles to the base 19, so as to form, as in the case of the tabs 24, a three-dimensional shape for the electrical terminal 22.

Two mutually opposite wings 26 protrude from the folded portions 25 toward the crimping region 20 and can flex elastically on a plane (the wings are tangent to a plane and when they flex they undergo deformation by "sliding" on said plane) which is substantially parallel to the laying plane of the base 19.

The wings 26 are formed by pressing from the folded portions 25.

The wings 26, in the non-deformed configuration, converge toward the longitudinal centerline of the electrical terminal 15.

The through opening 23 is substantially as wide as the distance of the folded portions 25 and has a substantially rectangular contour: the side 23*a* of said through opening 23 that lies closest to the non-crimped end of the terminal has a profile shaped like a circular arc.

Each guide 14 has an input 27, through which the respective electrical terminal 15 is inserted.

An abutment 28 for the non-crimped end of the corresponding inserted electrical terminal 15 is provided at the bottom of each guide 14.

A rib 29 protrudes from the part of each guide 14 that lies opposite the common wall 17 and is parallel to the rectilinear extension of said guide.

Mutually opposite recesses 30 are formed laterally on the mutually opposite sides of the rib 29 and are undercut with respect to the direction of insertion of the terminal 15 in the respective guide of the connector 13.

In particular, the rib 29 has a first portion 31, which is substantially as wide as, or at the most narrower than, the distance of the free ends 32 of the wings 26 when they are not deformed; a second portion 33, which follows the first portion 31 in the direction of the abutment 28 and increases in width up to the mutually opposite recesses 30, where there is a third portion 34, which is substantially as wide as the first portion 31.

When the electrical terminal 15 is inserted in the corresponding guide 14, the free ends 32 of the wings 26 of the terminal 15 are arranged in the recesses 30.

The electrical terminal 15 is thus locked between the recesses 30 and the abutment 28.

In this locking position, the circular through hole 18 of each guide 14 of the connector 13 is superimposed on the through opening 23 of the corresponding electrical terminal 15.

In this manner, the cylindrical electrical connection pin 12 can be inserted in the connector 13 and in the electrical terminal 15; in particular, the cylindrical pin 12 is laterally in contact with the folded portions 25.

Each rib 29 substantially has a dual function: to act as a "polarity" for the corresponding guide, so as to prevent the respective electrical terminal 15 from being inserted "backward" (i.e., so that the base 19 slides on the opposite wall instead of on the common wall 17), and to act as a "retention" abutment for said terminal.

When the electrical terminal 15 is inserted in the guide 14, the free ends 32 of the wings 26 in fact slide on the mutually opposite sides of the rib 29 without undergoing deformation, whereas they flex (moving mutually apart) when they slide on the second portion 33 of increasing width.

When the free ends 32 of the wings 26 arrive at the recesses 30, the non-crimped end of the electrical terminal 15 has arrived substantially at the abutment 28 provided on the bottom of the guide 14 (play is provided in order to ensure safe insertion and locking of the terminal between the abutment 28 and the recesses 30).

The free ends 32 of the wings 26, when they are located at the recesses 30, return to a non-deformed configuration.

An extracting action causes the free ends 32 of the wings 26 to jam against the undercut portion of the recesses 30.

In practice it has been found that the invention thus described solves the problems noted in known types of connection assembly for electrical cables; in particular, the present invention provides a connection assembly for electrical cables, of the type for connection to connectors with cylindrical-pin terminals, which allows to reduce the load required for the insertion of the electrical terminals in the connector of the connection assembly while increasing the load required for their extraction.

The provision of "retention" wings which can flex elastically substantially on the plane of arrangement of the force that causes the deformation (and therefore on a plane which is substantially parallel to the plane of the base 19) allows to provide wings with such a length as to achieve a low insertion load: in order to achieve the same flexing angle for a first wing which has a first length and a second wing which is shorter, it is in fact sufficient to apply a lower flexing force.

It should be noted that it has been possible to increase the length of the elastically flexible wing simply by arranging it on a plane which is substantially parallel to the plane of the base; in this manner, the three-dimensional dimensions of the electrical terminal are not modified substantially.

Further, the provision of terminals with wings which converge toward the centerline of the terminal causes their free ends to jam in an optimum manner on the undercut recesses of the longitudinal rib.

The increasing width of the central rib allows a gradual deformation of said wings, allowing the operator who inserts them to perceive distinctly the moment when the wings are arranged in the recesses of the longitudinal rib.

Moreover, the present invention provides a connection assembly for electrical cables, of the type for connection to connectors with cylindrical-pin terminals which allows to use electrical terminals which do not have problems in terms of "interlocking" and "entanglement" during the steps for crimping to the respective cables.

The inward convergence of the "retention" wings in fact prevents problems in terms of interlocking and entanglement of the terminals during their unwinding from the reel during crimping.

In practice, the materials employed, so long as they are compatible with the specific use, as well as the dimensions, may be any according to the requirements and the state of the art.

The disclosures in Italian Patent Application No. PD2004U000085 from which this application claims priority are incorporated herein by reference.

What is claimed is:

1. A connection assembly for electrical cables for connection to connectors with cylindrical-pin terminals, comprising: a connector which has a common wall and internal guides for a stable locking and accommodation of respective electrical terminals, said guides having, on the common wall, respective circular through holes; electrical terminals, each of which is provided with a base on which a crimping region is provided for crimping to electrical cables and a region for electrical contact, a through opening being provided at said region for electrical contact, a respective cylindrical pin for electrical connection that is insertable in said through opening in electrical contact with the terminal, folded portions being provided on opposite sides of said base which are folded so as to form a three-dimensional volume, two mutually opposite wings, which are elastically flexible and protrude from said folded portions toward said crimping region, converging toward a longitudinal centerline of the terminal, free ends of the wings of each one of said terminals that are insertable in a corresponding one of said guides arrangeable in recesses which are undercut with respect to a direction of insertion of the terminal in the connector, said recesses being formed on mutually opposite sides of a rib of the connector which is internal to said corresponding guide; said connector being further provided, at a bottom region of each one of said guides, with an abutment for a non-crimped end of a corresponding inserted electrical terminal, and wherein, when the electrical terminal is substantially locked between said recesses and said abutment, a circular through hole of said through holes is substantially superimposed on said through opening for insertion of said electrical connection pin.

2. The connection assembly of claim 1, wherein a said rib protrudes from the wall of the respective said guide which lies opposite said common wall, said rib being parallel to a rectilinear extension of said guide and having a first portion which is substantially as wide as, or at the most narrower than, a distance of the free ends of said wings when they are in a non-deformed condition, a second portion, which follows said first portion toward said abutment and increases in width up to said recesses which are provided on a third portion of the rib, which is substantially as wide as said first portion.

3. The connection assembly of claim 2, wherein said connector comprises three sleeves, which have a substantially rectangular transverse cross-section and are arranged mutually parallel and side-by-side on a same plane, forming said common wall, with a central one of said sleeves being non-aligned laterally with the other two.

4. The connection assembly of claim 2, wherein said through opening formed in said base is substantially as wide as a distance of said folded portions and has a substantially rectangular contour, a side of said through opening that lies closest to a non-crimped end of said electrical terminal being shaped like a circular arc.

5. The connection assembly of claim 4, wherein said two mutually opposite wings are flexible elastically on a plane which is substantially parallel to a laying plane of said base.

* * * * *